United States Patent [19]

Jacobson

[11] 4,093,337

[45] June 6, 1978

[54] SOCKET CONTACT

[75] Inventor: Tord Jacobson, Stockholm, Sweden

[73] Assignee: Telefonaktiebolaget L M Ericsson, Stockholm, Sweden

[21] Appl. No.: 743,508

[22] Filed: Nov. 19, 1976

[51] Int. Cl.[2] ..... H01R 13/12

[52] U.S. Cl. ..... 339/256 S

[58] Field of Search ..... 339/252 S, 253 S, 254, 339/255 RT, 256 RT, 256 S

[56] References Cited

U.S. PATENT DOCUMENTS

| | | | |
|---|---|---|---|
| 1,553,711 | 9/1935 | Myers | 339/255 RT |
| 2,153,177 | 4/1939 | Ecker | 339/254 M |
| 2,732,534 | 1/1956 | Giel | 339/256 S |

FOREIGN PATENT DOCUMENTS

| | | | |
|---|---|---|---|
| 1,137,783 | 10/1962 | Germany | 339/256 S |
| 29,822 of | 1914 | United Kingdom | 339/255 RT |

*Primary Examiner*—Joseph H. McGlynn

*Attorney, Agent, or Firm*—Hane, Roberts, Spiecens & Cohen

[57] ABSTRACT

A socket contact for a cylindrical contact pin has a helical spring which is secured by pressure against its ends and perpendicular to the axis of the socket, is laterally deflected by the contact surface of the contact pin at its insertion in the socket contact.

1 Claim, 5 Drawing Figures

SOCKET CONTACT

The present invention refers to a socket contact with a cavity for receiving a contact element which is provided with an outer contact surface.

In order to obtain good electrical contact between the voltage carrying parts of a socket contact and the contact elements inserted in the socket contact it is customary to provide the socket contact with some kind of springs, for example leaf springs, hair pin springs, helical springs, etc. An example of a socket contact provided with such springs is described in the German Pat. No. 867,258, which shows that a helical spring is arranged in the socket contact in order to press a contact pin inserted in the socket contact against a fix reaction part of metal, which is intended to effect the current carrying contact between the contact pin and the socket contact. In particular the contact pin is intended to be forced between the turns of a helical spring.

In the contact of the present invention socket a helical spring is held by pressure against its ends and located to press against an outer contact surface of a contact element which is inserted in a hole in the socket contact, and at the same time to effect the current carrying contact between the socket contact and the contact element. The spring is arranged to touch the contact surface of the contact element with the outside of a few of its turns and to be laterally deflected due to this contact. The socket contact is arranged to react against the pressure of the spring on the force against the force of the spring on the contact element.

The socket contact according to the present invention is especially suited to be realized with very small dimensions, for example with the dimensions and the fastening which appear in the Swedish Pat. No. 369,029. The socket contact may among other things be used to accept a telephone plug of common type, where several contact elements may be arranged as coaxial cylindrical sleeves.

In one development of the socket contact the centre of the helical spring has turns with smaller diameter than the turns at the ends of the helical springs, i.e. that the helical spring has the shape of an hourglass. With this configuration the helical spring when laterally deflected does not take up more space than a cylinder with the same diameter as that of the end-coils of the spring.

In the following the socket contact according to the invention is described more in detail with reference to the accompanying drawing where:

Figure 1:
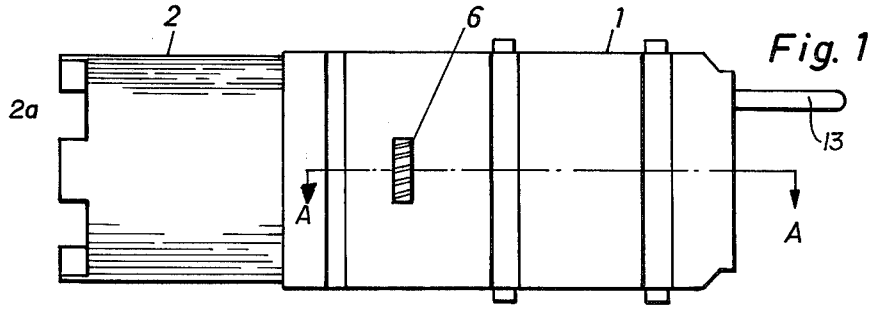
FIG. 1 shows a side view of the socket contact according to the invention.
Figure 2:
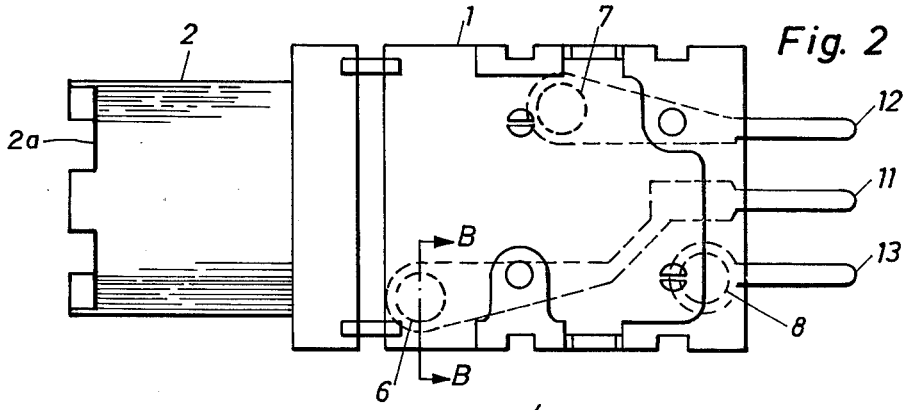
FIG. 2 shows a plane view of the socket contact.

The socket contact, as shown in FIGS. 1 and 2 has a main part 1 in the form of a parallelepiped from which extends cylindrical extension 2. The extension has a concentric cavity 2*a* for the reception of a not-shown, switch-plug. The cavity 2*a* also passes through the main part 1 of the socket contact as can be seen in FIGS. 3 and 4.

Figure 3:
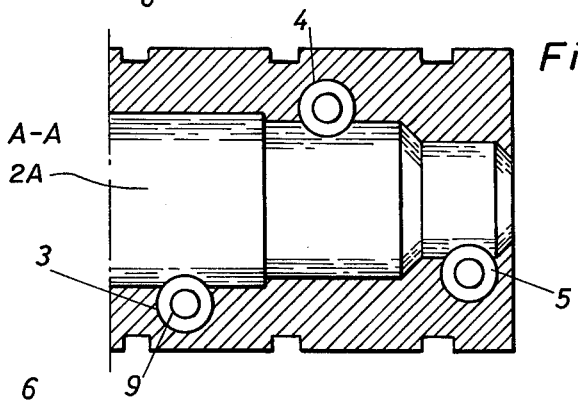
FIG. 3 shows a section viewed along line A—A of FIG. 1.

At the side of the cavity 2*a* a seat 3 is arranged for a helical spring 6, which most evidently appears from FIG. 3 at the chain-dotted section line B—B and also from FIGS. 1 and 2. As appears from FIG. 1 the helical spring 6 is visible through a small hole in the surface of the socket contact, as seen in FIG. 4 the spring 6 is also visible in the through cavity in the socket contact. In FIG. 5 the helical spring 6 is shaped as a helix spiral. Preferably the helix has center turns with shorter diameter than the turns at the end. Thus, the helical spring has hour-glass shape. One end of the helical spring is supported in the countersunk seat 3 in one of the walls of the socket contact and further controlled by means of a stud 9 in the center of the countersunk seat 3. The other end of the helical spring 6 is supported in a countersunk seat 10 where it presses against a metallic, mainly planar, conductor 11, which extends beyond the cover of the socket contact and to which line wires may be connected. The helical spring 6 is thus solely fixed in its place in the manner that it is contacted from the ends and supported by the countersunk seats 3 and 10 in two of the opposite walls of the socket contact and by the central stud 9.

Figure 4:
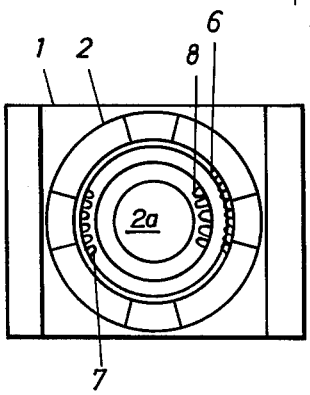
FIG. 4 shows an end view of the socket contact from the end where a contact element is to be inserted.
Figure 5:
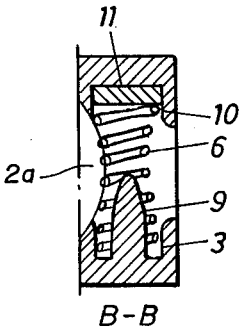
FIG. 5 shows a section through the line B—B and a helical spring included in the socket contact.

The helical spring 6, as appears from FIGS. 3 and 4, is placed so that it protrudes somewhat into the space of the cavity 2*a* of the socket contact. The helical spring 6 is consequently intended to be laterally deflected outwards by the cylindrical contact surface of a contact element inserted in the cavity of 2*a*, which almost completely fills the latter. Accordingly the spring presses against and scrapes the contact surface of the contact element during the insertion of the contact element, so that electric contact is achieved between the contact surface of the contact element, the helical spring 6 and the conductor 11.

The socket contact described herein is intended to receive a tripolar telephone plug. The contact is provided with three concentric contact surfaces with different diameters and isolated from each other. Although only the contact for conductor 11 has been shown and described in detail there are three such assemblages in the socket contact. In particular three seats 3, 4, and 5 are arranged with three helical springs 6, 7 and 8 and three conductors 11, 12 and 13 respectively. All helical springs and their fastenings are realized the same as described for the helical spring 6.

The shape of the helical springs and the conductors makes it possible to miniaturize the socket contact. The end surface of the socket contact shown in FIG. 4 has the width 10 mm and the height of 7.8 mm. The socket contact is intended to be fixed in electric control panels by fastening arrangements which are known in Swedish patent No. 369 029. The socket contact according to the appended claims can also be carried out with other numbers of poles than that described in the example and be intended for other contact elements other than the telephone plug mentioned in the description.

We claim:

1. In a socket contact with an axial cavity for the reception of a contact element which is provided with an outer contact surface, the socket contact having a helical spring which is part of the conducting path of the socket contact and is arranged to touch the contact surface of the contact element, the improvement comprising means for supporting the helical spring with a straight longitudinal axis which is perpendicular to the longitudinal axis of the axial cavity and partly recessed in the wall of the axial cavity, and partly extending laterally into the axial cavity, said means permitting lateral movement of the helical spring radially outward from the axial cavity by the contact surface of the contact element upon insertion thereof into the axial cavity, said means fixing the helical spring in place by pressure against the ends of the helical spring, and the center of the helical spring having turns with shorter diameters than the turns at the ends of the helical spring.

* * * * *

UNITED STATES PATENT OFFICE

CERTIFICATE OF CORRECTION

PATENT NO. : 4,093,337

DATED : June 6, 1978

INVENTOR(S) : Tord Jacobson

It is certified that error appears in the above-identified patent and that said Letters Patent are hereby corrected as shown below:

Foreign Application Priority Data

December 5, 1975 Sweden..... 7513745

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*